United States Patent [19]

Schulte

[11] Patent Number: 5,070,667

[45] Date of Patent: Dec. 10, 1991

[54] EASILY ASSEMBLED BUILDING

[75] Inventor: Steve W. Schulte, St. Charles, Mo.

[73] Assignee: Jay Henges Enterprises, Inc., Earth City, Mo.

[21] Appl. No.: 513,542

[22] Filed: Apr. 24, 1990

[51] Int. Cl.[5] ..... E04C 1/30; E04B 7/02

[52] U.S. Cl. ..... 52/241; 52/732; 52/488; 52/729; 52/276; 52/461; 52/464

[58] Field of Search ..... 52/280–282, 52/730–732, 238.1, 239–243, 243.1, 488, 729, 461, 464, 276–278, 275, 780, 781, 772, 489, 241

[56] References Cited

U.S. PATENT DOCUMENTS

| | | | |
|---|---|---|---|
| 1,605,597 | 11/1926 | Long | 52/282 |
| 1,749,648 | 3/1930 | Ray | 52/278 |
| 2,394,443 | 2/1946 | Guignon | 52/464 |
| 3,193,061 | 7/1965 | Downes | 52/242 |
| 3,340,663 | 9/1967 | Collard | 52/732 |
| 3,436,881 | 4/1969 | Schlecht | 52/282 |
| 3,712,015 | 1/1973 | Nelson | 52/729 |
| 3,821,868 | 7/1974 | Edwards | 52/241 |
| 3,989,399 | 11/1976 | Slowbe | 52/241 |
| 4,300,323 | 11/1981 | Meechem et al. | 52/730 |
| 4,689,930 | 9/1987 | Menchetti | 52/275 |

*Primary Examiner*—James L. Ridgill, Jr.

*Attorney, Agent, or Firm*—Gravely, Lieder & Woodruff

[57] ABSTRACT

A small building is constructed from components erected on a non-progressive basis. Among these components are base plates laid out in a rectangular configuration such that the ends of the plates form corners, posts which extend upwardly from the base plates at the corners as well as between the ends of the base plates, and roof caps which rest on the posts and support a roof. Each post includes a stud having a web which extends generally transversely with respect to the base plate and roof cap between which its post is located and flanges which project from the web generally parallel to the base plate and roof cap. Each post also has a stud cover having a center wall, a positioning groove along the center wall, and flanges projecting beyond the center wall. The positioning groove of the stud cover receives the web of the stud, and screws pass through the center wall of the stud cover and thread into the web of the stud, thus securing the stud cover to the stud with their flanges parallel. In addition, the components of the building include wall panels which fit between the base plates and roof caps and have their edges captured between the flange of the studs and stud covers for the posts. The stud cover are easily detached from their respective studs, and when the covers on each side of a panel are removed, the panel itself is easily withdrawn without disturbing the remainder of the building.

20 Claims, 3 Drawing Sheets

EASILY ASSEMBLED BUILDING

BACKGROUND OF THE INVENTION

This invention relates to small buildings and components for such buildings, and more particularly to buildings formed from components which may be assembled and disassembled on a non-progressive basis.

Small buildings constructed from panels are found in a variety of locations and uses. For example, they serve as booths for parking lot attendants, as cashier's booths at automotive service stations, as small guard houses for security personnel at large industrial complexes, and as in-plant offices at factories. Some of these small buildings are furnished as preassembled structures, while others are furnished as preassembled components. The latter, of course, may be shipped much more economically than the former, but require assembly at the site where the building is to be located.

The preassembled components required to erect a small building at the site include rectangular panels which fit together to form the walls that enclose the interior of the buildings. The side edges of these panels may lend themselves to progressive or non-progressive assembly—and of course disassembly as well. Those wall panels which are configured for progressive assembly usually fit together quite rapidly, with one being connected to the other in succession until the array of panels closes upon itself to form the enclosing walls of the building. The assembly requires relatively little effort and expense, but once the building is assembled, it is not easily disassembled for repairs. Thus, if a single panel is damaged, it is difficult to remove it and repair it. Moreover, in order to accommodate the snap fits, each panel must have a metal side edge that is configured to mate with a metal side edge on the adjacent panel. Usually the metal side edges are relatively heavy aluminum extrusions.

U.S. Pat. No. 4,196,555 shows a progressive system in which the panels during assembly pivot relative to each other and snap into engagement. The system requires very little effort to assemble and uses only a minimum of mechanical fasteners.

With a non-progressive system, the individual panels are easily detached one from another after the building is erected so that a damaged panel is easily replaced. Moreover, the mullions between the panels are relatively lightweight, since they need not accommodate snap fits which are typical of some progressive systems. Indeed, the side edges of the panels require no special configurations or metal shapes. In spite of those advantages, progressive systems utilize a multitude of screws or other fasteners, and thus a building which utilizes non-progressive components requires more time to erect than a building which utilizes progressive components.

The present invention resides in a building having panels and other components which are easily and quickly assembled on a non-progressive basis. Among the components are wall panels, and by reason of the non-progressive construction any panel may be removed without disturbing the remaining panels.

DESCRIPTION OF THE DRAWINGS

In the accompanying drawings which form part of the specification and wherein like numerals and letters refer to like parts wherever they occur.

DETAILED DESCRIPTION

Figure 1:
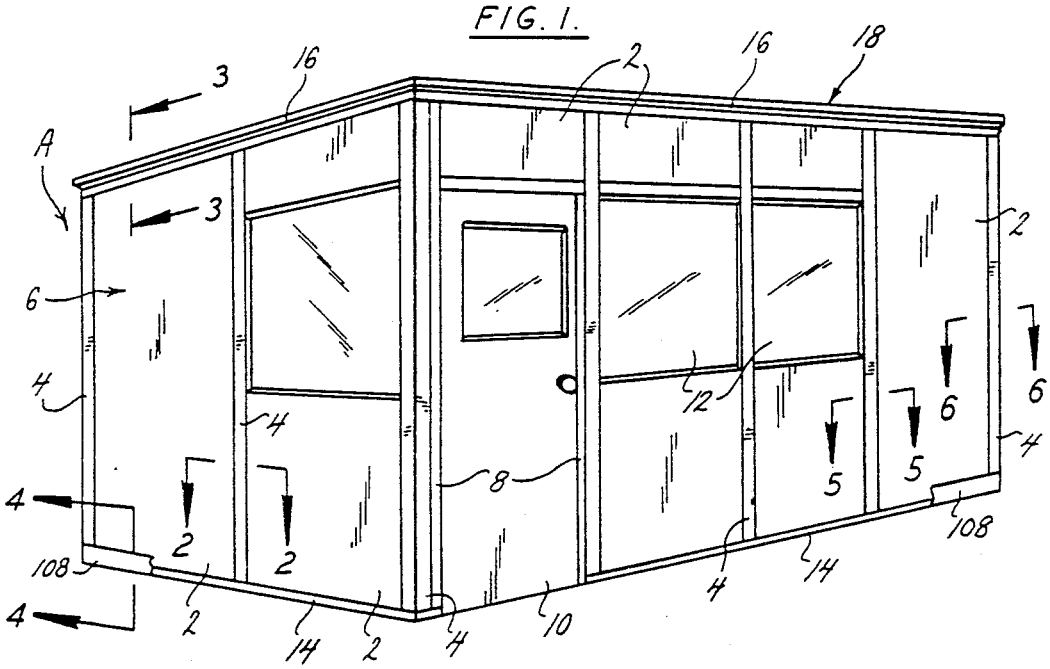
FIG. 1 is a perspective view of an easily assembled building constructed in accordance with and embodying the present invention.

Referring now to the drawings, a small building A (FIG. 1) is constructed from components assembled on a non-progressive basis. Among the components are wall panels 2 which are set along the periphery of the building where they are joined together at posts 4 to form walls 6. The panels 2 are furnished in standard widths such as 2 feet or 4 feet and come in a variety of configurations. For example, one type of wall panel 2 may be uniform throughout, another type may contain a door frame 8 having a door 10 hinged to it, and still another may hold a window 12. The panels 2 and posts 4 rest on base members or plates 14 and terminate at upper members or roof caps 16, there being a single base plate 14 and roof cap 16 along each wall 6. The several base plates 14 follow the periphery of the building A and meet at corners where they are mitered and joined together. The same holds true with regard to the several roof caps 16, which provide the underlying support for a roof 18.

Figure 2:
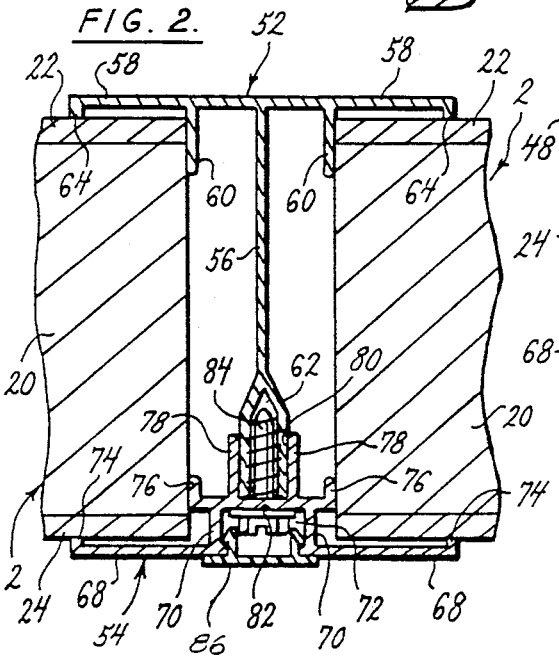
FIG. 2 is a sectional view of the building taken along line 2—2 of FIG. 1 and showing a basic post in cross section.

Each wall panel 2 is typically about 3 inches thick and includes (FIG. 2) a core 20 which is located between inside and outside facing sheets 22 and 24. The core 20 is formed from a relatively rigid material that serves as a good thermal and sound insulator. Expanded polystyrene is suitable for this purpose. The facing sheets 22 and 24 may be pressed board about $\frac{1}{8}$ to $\frac{1}{4}$ inch thick which are bonded to the core 2. They may be covered with a protective sheathing of vinyl or metal, depending on the type of environment to which the sheet 22 or 24 is exposed. In the simplest configuration for the panel 2, the core 20 and facing sheets 22 and 24 extend throughout the entire panel 2, from top to bottom and from side to side (FIG. 1). In more complex panels 2, the core 20 and facing sheets 22 and 24 are diminished in size to provide space for a door frame 8 and door 10 or a window 12. The panels 2 are of uniform height, and that height is slightly less than the height of the posts 4.

Each base plate 14 is in effect a channel (FIG. 4), and as such has a web 30 which lies directly beneath the panels 2 of the wall 6 along which it extends and outside and inside flanges 32 and 34 which project upwardly from the margins of the web 30. The outside flange 32 rises somewhat higher than the inside flange 34. For example, the outside flange may be 1 inch high, whereas the inside flange may be 5/16 inch. On its outwardly presented face midway between its upper and lower margins, the outside flange 32 is provided with very narrow V-shaped groove 36 and likewise the web 30 midway between its flanges 32 and 34 is provided with another narrow V-shaped groove 38. The grooves 36 and 38 are used to center drill bits for drilling screw holes through the flange 32 and web 30. In this regard, the base plate 14 is secured to some underlying structure, such as a floor, pavement or foundation, with screws 40 which pass through the web 30 into the underlying structure or into an anchor set in the underlying structure. On the other hand, the lower ends of the posts 4 are attached to the base plate 14 by self-tapping screws 42 which pass through the outside flange 32 and thread into the lower ends of the posts 4.

Each roof cap 16 is likewise channel-shaped (FIG. 3), it having a horizontal web 44 from which outside and inside flanges 46 and 48 depend. The web 44 rests on the upper end of the posts 4 and extends over the upper edges of the panels 2, while the flanges 46 and 48 project downwardly over the outside and inside facing sheets 22 and 24, respectively, to obscure the top edges of the panels 2. The two flanges 46 and 48 are equal in height, that height being about 1¼ inch. In addition, the web 44 projects laterally beyond the outside flange 46 and merges with an upwardly directed lip 50.

Figure 3:
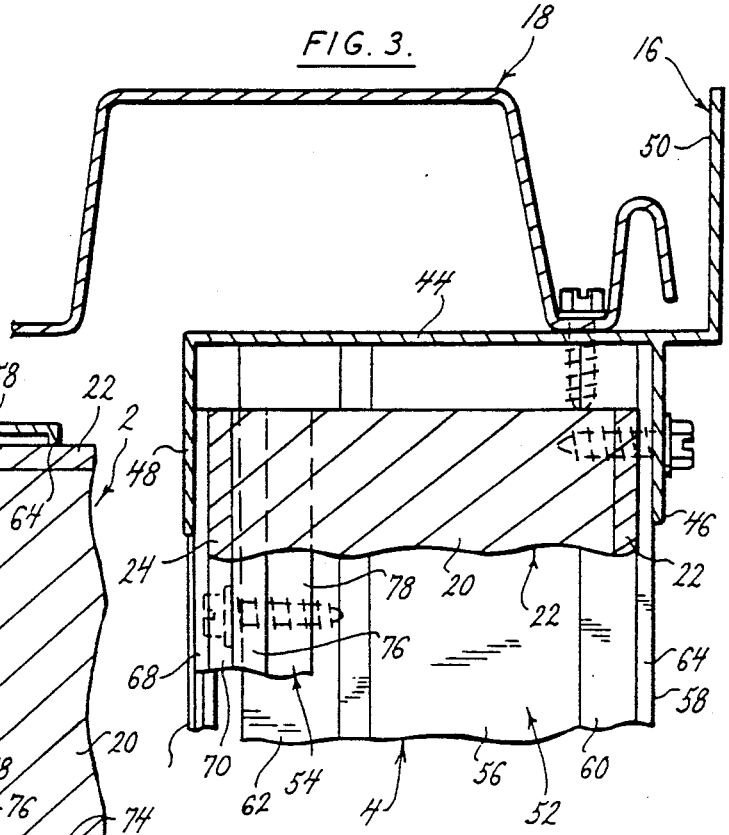
FIG. 3 is a sectional view taken along line 3—3 of FIG. 1 and showing a roof cap in cross section.
Figure 4:
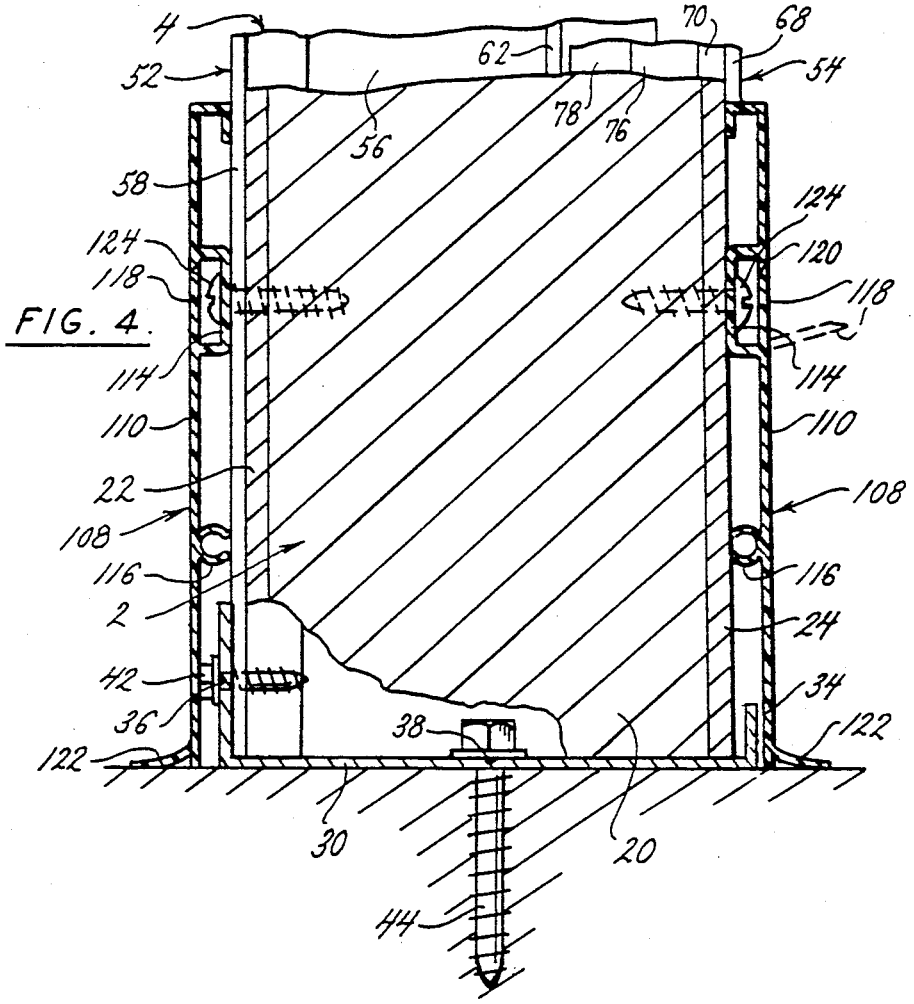
FIG. 4 is a sectional view taken along line 4—4 of FIG. 1 and showing a base plate and cove base in cross section.

The posts 4 fit between and join adjacent wall panels 2 (FIG. 1). They rise from the base plates 14 of the several walls 6 and terminate at the roof caps 16. Indeed, their lower ends fit between the flanges 32 and 34 of the base plate 14 and rest on the web 30 of the plate 14 (FIG. 4). Their upper ends fit between the flanges 46 and 48 of the roof cap 16, and indeed the posts 4 support the roof caps 16 slightly above the upper edges of the panels 2 (FIG. 3). Like the panels 2, the posts 4 come in several configurations, and the configuration for a particular post 4 depends on its location and function in the building A.

In its simplest or basic configuration (FIG. 2), the post 4 consists of a stud 52 which is normally presented outwardly and a stud cover 54 which is attached to the stud 52 and is normally presented inwardly. Preferably, both the stud 52 and stud cover 54 are aluminum extrusions. The stud 52 possesses a generally T-shaped cross-section, it having a center web 56 and flanges 58 which project laterally from one margin of the web 56. Indeed, the two flanges 58 align and produce a uniform planar surface on the exterior of the stud 52. That surface lies immediately inside the outside flange 32 of the base plate 14 and the outside flange 46 of the roof cap 16, so for all intents and purposes the flanges 58 of the basic stud 52 and the outside flanges 32 and 46 of the base plate 14 and the roof cap 16 are coplanar. Each flange 58 carries a rib 60 which lies parallel to the web 56, but is of course offset from the web 56 and not nearly as deep. The flanges 58 overlie the outside facing sheets 22 of the two panels 2 joined by post 4, while the ribs 60 serve as abutments against which the side edges of those panels 2 may bear to properly locate the panels 2. Whereas the web 56 along its one margin merges into the two flanges 58, it possesses a bifurcated configuration along its opposite margin, that is to say along that margin it has a narrow channel 62 which opens inwardly toward the stud cover 54. Finally, each flange 58 along its outer or free margin is provided with a slight bead 64, that projects rearwardly, and it is along the beads 64 that flanges 58 actually bear against outside facing sheets 22 of the two panels 2 joined by the basic post 4.

The stud cover 54 includes (FIG. 2), a depressed center wall 66 and a pair of flanges 68, each of which is joined to the center wall 66 by a short connecting wall 70 such that depressed center wall 66 and the two connecting walls 70 produce a recess 72 in the cover 54. The two flanges 68 lie in the same plane and project laterally beyond the center wall 66 so as to overlie the inside facing sheets 24 of the two panels 2 joined by the post 4. Actually, the flanges 68 bear against the inside facing sheets 24 along beads 74 which are located along the free margins of those flanges, and when so disposed, the flanges 68 of the stud cover 54 lie in essentially the same plane as the inside flange 34 of the base plate 14 and the inside flange 48 of the roof cap 16. The depressed center wall 66, like the flanges 68, projects laterally beyond the connecting walls 70, but not nearly as far, and along its side margins merges into ribs 76 which align with the ribs 60 of the stud 52. The ribs 76 likewise serve as abutments for locating the panels 2 with respect to the post 4. In addition to the ribs 76, the depressed center wall 66 has a pair of spaced apart positioning walls 78 which are set inwardly from the ribs 76 and are somewhat deeper. Indeed, the spacing between the wall 78 is only slightly greater than the width of the channel 62 along the free margin of the web 56 on the stud 52. The walls 78 provide a groove 80 which opens toward the stud 52 and receives the channel 62 on the web 56. Thus, the positioning walls 78 serve to locate the stud cover 54 with respect to the stud 52. Finally, the depressed center wall 66 has a slight V-shaped groove 82 which is centered between the two connecting walls 70. The groove 82 serves to locate a drill bit for providing screw holes in the center wall 66—indeed, holes which accept self-tapping screws 84 that thread into the narrow channel 62 of the stud 52. The threads on the shanks of the screws 84 bite into the two walls of the channel 62 and thereby fasten the stud cover 54 to the stud 52. The heads of the screws 84 and the recess 72 in which they are located are obscured by a cover strip 86 which snaps into the recess 72.

The two wall panels 2 which are joined by the basic post 4 consisting of the stud 52 and stud cover 54 are clamped along their edges between the flanges 58 and 68 of the stud 52 and cover 54, respectively. Moreover, the edges of the panels 2 should abut the locating ribs 60 and 76 on the stud 52 and stud cover 54, respectively.

Figure 5:
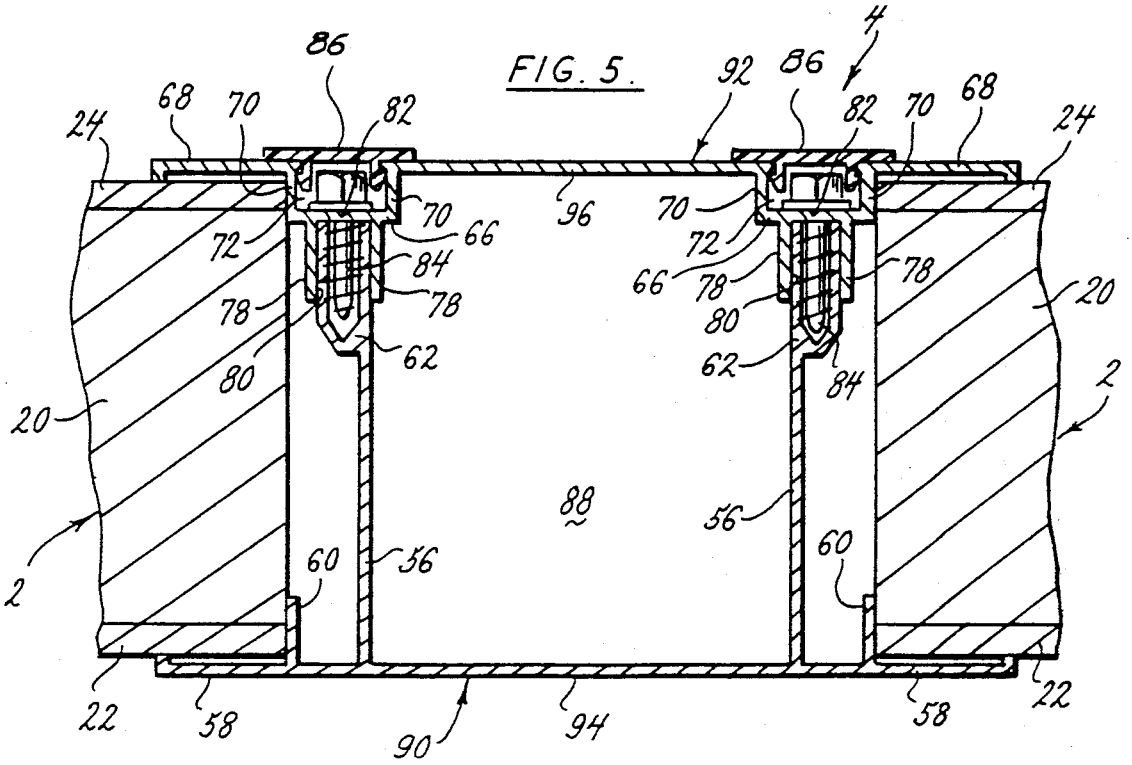
FIG. 5 is a sectional view taken along line 5—5 of FIG. 1 and showing a wireway post in cross section.

In a more complex configuration (FIG. 5), a post 4 may contain a wireway 88 for holding electrical wiring and for receiving electrical switches and receptacles. The wireway post 4 has a stud 90 and stud cover 92 which are very similar to their counterparts in the basic post 4. However, the stud 90, instead of having one web 56, has two webs 56 and between the two webs 56 has an intermediate wall 94 which lies flush with the flanges 58, so that from the outside of the building A the wall 94 and flanges 58 appear as one. The space between the two webs 56 forms the wireway 88. The stud cover 92, on the other hand, has two depressed walls 66 and two grooves 80 separated by an intermediate wall 96 that is coplanar with the two flanges 58. The recesses 72 retain cover strips 86 which obscure them. Also, the outermost connecting walls 70 serve as abutments against which the edges of the panel 2 locate. The wireway 88 contains wires which may connect with switches and receptacles mounted in the intermediate wall 96 of the stud cover 92.

Figure 6:
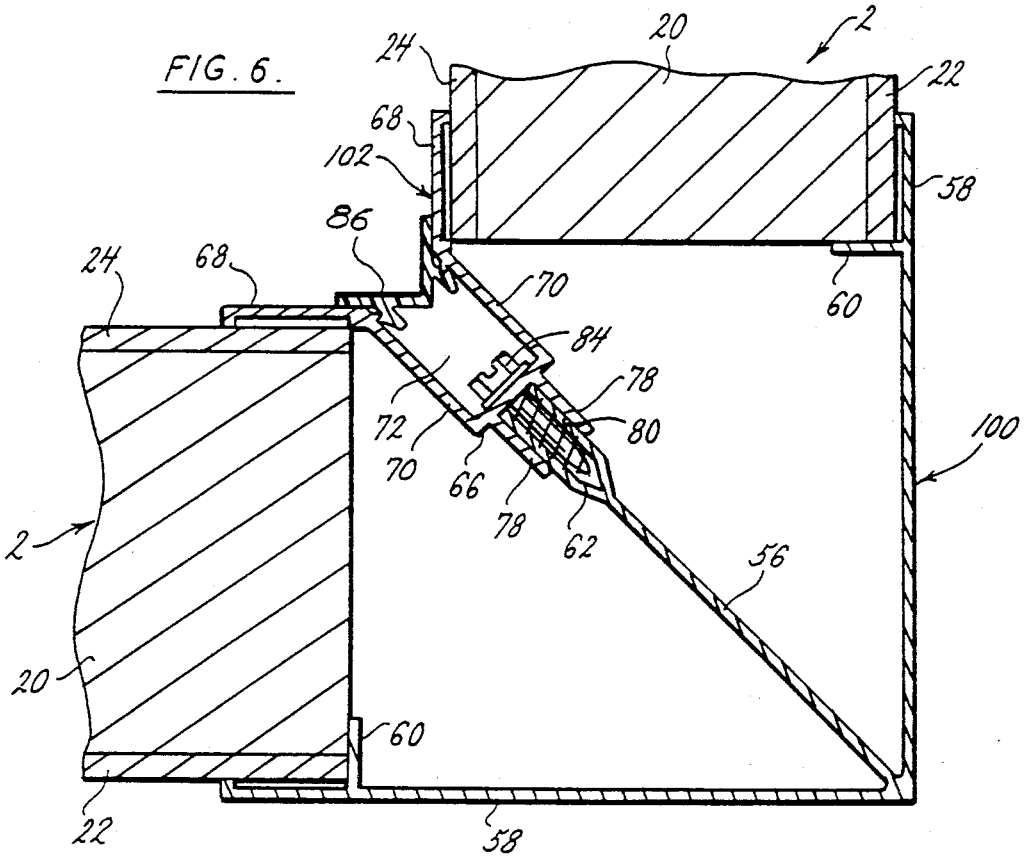
FIG. 6 is a sectional view taken along line 6—6 of FIG. 1 and showing a columnar post in cross section.

In another configuration (FIG. 6), the posts 4 form the corners of the building A, and as such join wall panels 2 at right angles with respect to each other. Each corner post 4 likewise has a stud 100 and a stud cover 102.

Like the stud 52, the stud 100 has a web 56 which along one of its margins merges into narrow channels 62 and along its other margin into flanges 52, but the flanges 52 do not align; instead they are located at right angles with respect to each other, and moreover are considerably wider than the flanges 58 of the stud 52. The web 56 lies within the included angle between the flanges 58 and indeed bisects that angle. As such, the web 56 for the stud 100 is located at 45° with respect to each flange 58. The flanges 58 near their free margins are provided with ribs 60 that serve to locate the adjacent panels 2.

The stud cover 102, while possessing many of the same components as the basic stud cover 54, appears considerably different. In this regard, the stud cover 102 has a depressed center wall 66 and flanges 68, with connecting walls 70 joining the flanges 68 to the center wall 66, but the connecting walls 70 are considerably deeper than their counterparts in the basic stud cover 54, as is the recess 72 formed by them. Moreover, the included angle between each flange 68 and its connecting walls 70 is 135°, and as a consequence, the two flanges 68 are oriented at 90° with respect to each other. The center wall 66 of the stud cover 102 has positioning walls 78 which form a groove that receives the channel 62 on the web 56 of the stud 100, and the stud cover 102 is indeed fastened to the stud 100 with screws 84 which pass through the center wall 66 of the cover 102 and thread into the channel 62 of the web 56 for the stud 100. However, the flanges 58, while having beads 74 along their free margins, are not provided with ribs 76. The recess 72 of the stud cover 102 is closed by a cover strip 86 of angular cross section, and it, like its counterparts, snaps into the recess 72.

The roof 18 rests on the webs 44 of the roof caps 16 (FIGS. 1 & 3) and spans the space between the roof caps 16 on opposite walls 2. As such, it, like the walls 2, serves to enclose the interior of the building A.

At the bottom of each wall 6 of the building A are cove bases 118 (FIG. 4), which extend the full length of the wall 6 without interruption, both on its inside and outside surfaces, except where the wall 6 has a door. The cove bases 118 serve to obscure the base plate 14 and the lower ends of the posts 4. The base 108 is extruded from a polymer—actually two polymers of different flexibility which are compatible in the sense that they join together as they are extruded and remain together after they rigidify. The base 108 includes a facing section 110 which possesses the more rigid polymer, and the facing section 110 includes a rearwardly directed flange 112 along its upper margin, a forwardly opening channel 114 below the flange 112 and a spacer 116 below the channel 114, yet above the lower margin. The flange 112, channel 114 and spacer 116 all possess essentially the same depth and when forced against inside facing sheet 24 of one of the wall panels 2, presents the remainder of the facing section 110 slightly outwardly from that facing sheet 24.

Joined to the lower margin of the channel 114 is a flap 118 which normally covers the channel 114 and indeed tucks behind a slight lip 120 that projects downwardly from the upper margin of the channel 114. The flap 118 is formed from the polymer having the greater flexibility so that it can be folded outwardly to expose the interior of the channel 114.

Quite close to the lower margin of the facing section 110, a lip 122 is joined to the facing section 110, and it too is formed from the elastomer having the greater flexibility. When left unrestrained, the lip 122 projects generally downwardly, but its flexibility enables it to project outwardly and follow slight contours in carpeting or other floor coverings.

The cove base 108 is attached to the panels with screws 124 which pass through the channel 114 and thread into the facing sheets 22 or 24 of the wall panels 2 along which it extends.

The building A is supplied in a disassembled condition, that is with its wall panels 2, posts 4, base plates 14, roof caps 16, and cove bases 108 detached from each other. This, of course, enables it to be transported in a highly compact condition.

To erect the building A at the building site, a workman first fastens the base plate 14 to the underlying supporting surface such as by screws 36 which pass through the web 30 of the plate 14 and thread into the underlying surface or into anchors set into that surface (FIG. 4).

Then one of the corner studs 100, with its stud cover 102 detached, is set into the mitered corner where two base plates 14 meet and is fastened to the base plate 14 by screws 42 which extend through the outside flanges 32 of the two plates 14 and thread into the flanges 58 of the stud 100. With the corner stud 100 in place, the wall panels 2 that belong next to that corner stud 100 are set in place. To do so, one simply lifts the panels 2 into the spaces between the two flanges of the base plates 14 and slides those panels toward the corner stud 100 until the edges of the panels 2 abut against the ribs 60 on the flanges 58 of the stud 100. This forms the beginning of two walls 6. To keep the panels 2 upright, the stud cover 102 is secured, at least loosely, to the stud 100 by driving screws 84 through the depressed center wall 66 of the stud cover 102 and into one of the channels 62 of the web 56 for the stud 100.

The workman thereafter installs basic studs 52 or wireway studs 90 against the opposite edges of the two erected panels 2, bringing the ribs 60 on the flanges 58 of those studs against the edges on the panels 2 to properly locate the studs 52 or 90. At each new stud 52 or 90 a screw 42 may be driven through the outside flange 32 of the base plate 14 from which that flange 32 extends and into one of the flanges 58 of the studs 52 or 90.

The workman installs the remaining wall panels 2 and posts 4 in a similar manner until all four walls 6 are complete. Once the screws 84 that hold the stud covers 54, 92 and 102 in place are tightened, the workman installs the cover strips 86 to conceal the recess 72 in the stud covers 54, 92 and 102. Next the roof caps 16 are placed over the tops of the walls 6 (FIG. 3), that is over the upper edges of the wall panels 2 and the upper ends of the studs 52, 90 and 100 such that the webs 44 of the caps 16 rest on the upper ends of the studs 52, 90 and 100, while the flanges 46 and 48 obscure those upper edges as well as the upper edges of the panels 2. The roof caps 16 are joined together at their mitered corners. At this time the roof 18 is placed over the space enclosed by the walls 6. It rests on the webs 44 of the four roof caps 16 and is confined laterally by the upwardly directed lip 50 on the roof caps 16. Finally, base coves 108 are attached to the inside and outside faces of the walls 6 with screws 124 which pass through the channels 114 in the coves 108 and thread into the facing sheets 22 and 24 of the wall panels 2.

Figure 7:
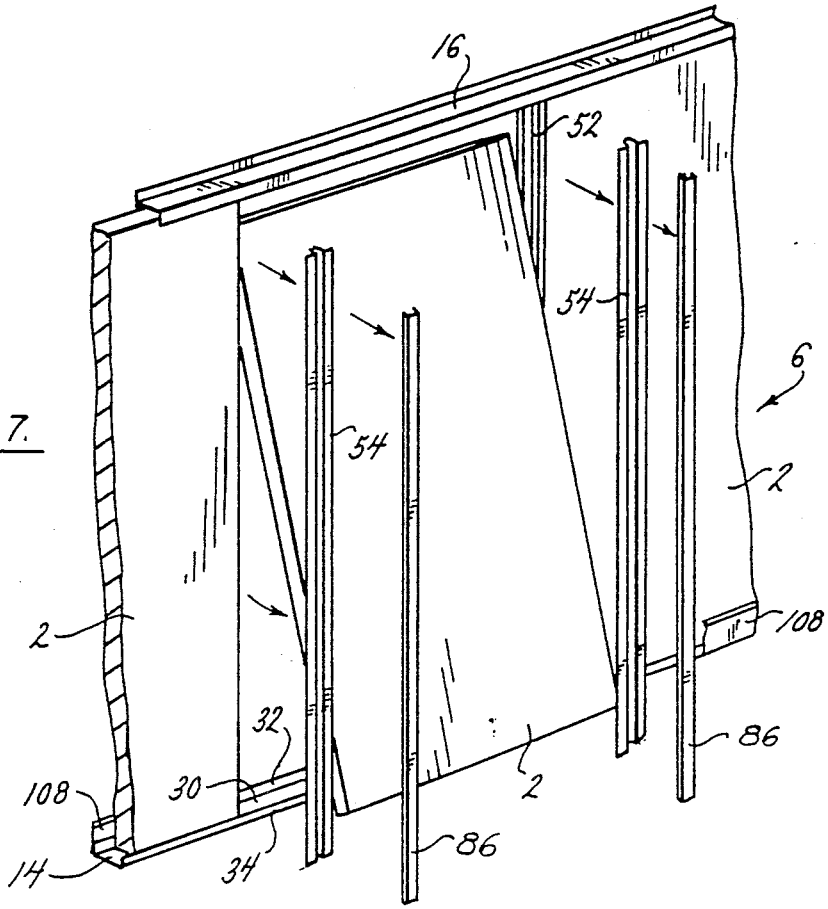
FIG. 7 is a perspective view of a wall showing one of the panels being removed from that wall.

To replace one of the wall panels 2 (FIG. 7), a workman first detaches the cove bases 108 from the wall 6 in which the panel 2 exists. He then removes the cover strips 86 from the stud covers 54, 92, or 102 on each side of the panel 2. Then he detaches the stud covers 54, 92 or 102 by removing the screws 84 which hold them against the webs 56 of the studs 52, 90 or 100 and lifts them away from the wall panel 2. Then by grasping the sides of the panel 2, the workman simply lifts the panel 2 upwardly until its lower edge is above the inside flange 34 of the base plate 14. In this regard, the panel 2 is slightly shorter than the posts 4 on each side of it so that a space exists within the roof cap 16, that is between the flanges 46 and 48 of the roof cap 16, to accommodate this slight displacement of the panel 2. Once the lower edge of the panel 2 clears the inside flange 34 of the base plate 14, the lower end of the panel 2 is swung inwardly over the inside flange 34 of the base plate 14 while its upper end is withdrawn from the space between the flanges 46 and 48 of the roof cap 16. This separates the panel 2 from the wall 6 without otherwise disturbing the wall 6. The withdrawn panel 2 is replaced with another panel 2 in the reverse of the foregoing sequence.

Since each post 4 contains a stud and a cover, and the former possesses a web 56 which extends from one of the base plates 14 to the corresponding roof cap 16, the integrity of any wall 6 is not seriously impaired when the stud covers 54, 92 or 102 on each side of a panel 2 are removed or even when the panel 2 is separated from the wall 6. Thus, should a panel 2 be damaged, it may be easily and quickly replaced.

This invention is intended to cover all changes and modifications of the example of the invention herein chosen for purposes of the disclosure which do not constitute departures from the spirit and scope of the invention.

What is claimed is:

1. A building wall comprising: spaced apart posts, each including a stud, a stud cover located along the stud, and securing means for connecting the stud cover to the stud such that the stud cover may be detached from the stud, the studs having flanges which project toward each other and lie in essentially the same plane, the stud covers having flanges which project toward each other and lie in essentially the same plane which is spaced from the plane of the flanges for the studs; a base member extending beneath and being attached to the posts, the base member having a first flange which projects upwardly and lies generally in the plane of the flanges for the studs of the posts, and a second flange which projects upwardly and lies generally in plane of the flanges for the stud covers, an upper member extended over and attached to the posts, the upper member having first flanges which project downwardly and lie generally in the plane of the flanges for the studs and second flanges which project downwardly and lie generally in the plane of the flanges for the stud covers; whereby the posts, base member and upper member frame an area; and a wall panel located in the area framed by the posts and the upper and lower members, the panel at its sides being captured between the flanges of the studs and stud covers for the posts, at its lower end being located between the flanges of the lower member, and at its upper end being located between the flanges of the upper member, the height of the panel being such that it may be lifted upwardly sufficiently to clear the second flange of the base member so that the panel may be removed from the framed area when the stud covers are detached from the studs.

2. A wall for a building, said wall comprising: a base plate having a horizontally directed web and first and second flanges directed upwardly from the web, the first and second flanges being spaced apart and extended in the general direction of the wall; spaced apart posts extending upwardly from the base plate with each post including a stud, a stud cover, and connecting means for attaching the stud cover to the stud such that the stud cover may be detached from the stud, the stud being attached to the base plate and having flanges which project in the general direction of the wall, the stud cover having flanges which also project in the general direction of the wall and are spaced from the flanges of the stud; a cap supported on and attached to the posts, the cap having a horizontally directed web and first and second flanges which project downwardly from the web, the first and second flanges of the cap being spaced apart and extended in the general direction of the wall; and wall panels fitted between the posts and extending vertically between the base plate and cap, each panel along its sides being captured between the flanges on the studs and stud covers for the posts between which the panel fits and at its upper and lower ends being located between the first and second flanges of the cap and base plate, the height of the panel being less than the spacing between the webs of the cap and base plate and further being such that the panel may be lifted over the second flange of the base plate and removed from the wall when the stud covers for the posts along its sides are detached from the studs of those posts.

3. A wall according to claim 2 wherein at least one of the posts is located at the end of the wall where it forms a corner, and wherein the stud of that corner post has its flanges arranged at 90° with respect to each other and the web is located midway between the two flanges; wherein the flanges for the stud cover of the corner post are also located at 90° with respect to each other and the stud cover includes a center wall which separates the two flanges and is offset with respect to them so that a recess exists between the two flanges where the center wall is located; and wherein the connecting means are screws extend through the center wall of the stud cover for the corner post and into the web for the stud of that post.

4. A wall according to claim 2 wherein the web for the stud of each post extends to and is received in the stud cover for the post.

5. A wall according to claim 4 wherein the stud cover for each post is provided with spaced apart positioning walls which form a groove that opens toward the stud of the post and the web on the stud projects into the groove.

6. A wall according to claim 4 wherein the connecting means is screws.

7. A wall according to claim 6 wherein the stud cover for each post has a depressed wall located between the flanges for the post and offset toward the stud for the post; and wherein the screws pass through the depressed wall and thread into the stud.

8. A wall according to claim 7 wherein the stud cover for each post is further provided with spaced apart positioning walls which project from the depressed wall to form a groove which opens toward the stud for the post; and wherein the web for the stud of the post projects into the groove on the stud cover.

9. A wall according to claim 8 wherein the web of the stud has a channel which fits into the groove formed by the positioning walls of the stud cover and the screws thread into the channel.

10. A wall according to claim 8 wherein the flanges of the stud for at least some of the posts are provided with ribs which project from the flanges and serve as abutments against which the side edges of the panels that are on each side of the post may abut to locate those panels with respect to the post.

11. A building comprising: base plates located on a supporting surface and having ends that meet at corners, each base plate including a web and outside and inside flanges projecting upwardly from the web such that the web is between the two flanges; posts extending upwardly from the base plates, both at the corners formed by the base plates and between the ends of at least some of the base plates, each post including a stud and a stud cover, the stud having a web which extends generally transversely with respect to the base plate or plates over which the post is located and flanges which project laterally from the web, the stud cover having a center wall where the stud cover is attached to the web of the stud and flanges which project from the center wall generally parallel to the flanges of the stud; roof caps supported on the posts above the base plates and likewise having ends that meet at corners, each roof cap having a web that rests on the upper ends of the studs for the posts and parallel flanges which project downwardly; and wall panels located between the base plates and roof caps such that the panels occupy the spaces between the posts, at least one of the panels having its upper edge between the flanges of the roof cap which extends over it, its lower edge between the flanges of the base plate which extends beneath it, and its side edges between the spaced apart flanges of the studs and stud covers for the posts between which it is located.

12. A building according to claim 11 wherein the center wall of the stud cover for a post has spaced apart positioning walls which form a groove that opens toward the stud for the post, and the web for the stud projects into the groove.

13. A building according to claim 11 wherein the stud covers are detachable from the studs for their respective posts.

14. A building according to claim 11 wherein the panels are shorter than the studs.

15. A building according to claim 11 wherein the panels are shorter than the distance between the webs of the base plate and roof cap by a distance at least about as great as the height of the base plate flange on that side of the base plate at which the stud covers are located, so that when the stud covers on each side of the panel are detached and removed from their studs, the panel may be lifted upwardly enough to enable its lower edge to clear the base plate flange on the side of the base plate at which the stud covers are located, whereby the panel may be removed without disturbing the remaining panels.

16. A building according to claim 15 wherein the flanges for the studs of the posts lie generally coplanar to the outside flanges of the base plates and roof caps.

17. A building according to claim 15 wherein the web for the stud of a post has along its edge a narrow channel which fits into the groove for the stud cover of the post; and wherein the stud cover for a post is attached to the stud of the post by screws which pass through the center wall of the stud cover and thread into the channel of the web for the stud.

18. A building according to claim 15 wherein the center wall of the stud cover is offset with respect to the flanges so that a groove, which opens away from the stud to which the cover is attached, exists between the two flanges of the stud cover.

19. A building according to claim 15 wherein the flanges of the studs for the posts are provided with ribs which project toward the flanges of the stud cover and serve as abutments against which the side edges of the adjacent panels may bear to properly locate those panels with respect to the post in which the stud is located.

20. A building according to claim 19 wherein the flanges of the stud covers for the posts lie generally coplanar to the inside flanges of the base plates and roof caps.

* * * * *